US008740055B2

(12) United States Patent
Stahlecker

(10) Patent No.: US 8,740,055 B2
(45) Date of Patent: Jun. 3, 2014

(54) CUP MADE OF PAPER MATERIAL AND METHOD FOR THE PRODUCTION OF A CUP MADE OF PAPER MATERIAL

(75) Inventor: Werner Stahlecker, Goeppingen (DE)

(73) Assignee: PTM Packaging Tools Machinery PTE. Ltd., Singapore (SG)

( * ) Notice: Subject to any disclaimer, the term of this patent is extended or adjusted under 35 U.S.C. 154(b) by 440 days.

(21) Appl. No.: 13/065,724

(22) Filed: Mar. 29, 2011

(65) Prior Publication Data

US 2011/0240726 A1 Oct. 6, 2011

Related U.S. Application Data

(60) Provisional application No. 61/343,880, filed on May 5, 2010.

(30) Foreign Application Priority Data

Mar. 30, 2010 (DE) ..... 10 2010 013 951

(51) Int. Cl.
*B65D 3/30* (2006.01)
*B65D 3/06* (2006.01)

(52) U.S. Cl.
USPC ..... 229/400; 229/919

(58) Field of Classification Search
USPC ..... 229/919, 403, 4.5, 400; 220/519, 515, 220/654, 651, 648, 670, 672, 674, 675
See application file for complete search history.

(56) References Cited

U.S. PATENT DOCUMENTS

| | | | | |
|---|---|---|---|---|
| 3,526,316 | A * | 9/1970 | Kalogris | 206/217 |
| 3,568,878 | A * | 3/1971 | Fotos | 206/520 |
| 4,852,793 | A | 8/1989 | Homma et al. | |
| 4,997,125 | A | 3/1991 | Glerum | |
| 5,769,311 | A * | 6/1998 | Morita et al. | 229/403 |
| 6,109,518 | A * | 8/2000 | Mueller et al. | 229/403 |
| 6,588,654 | B2 * | 7/2003 | Nakashima | 229/402 |
| 6,598,786 | B1 * | 7/2003 | Guo | 229/403 |
| 7,100,700 | B2 | 9/2006 | D'Amato | |

(Continued)

FOREIGN PATENT DOCUMENTS

| | | | |
|---|---|---|---|
| AT | 506 749 | A1 | 11/2009 |
| DE | 10 2004 056 932 | A1 | 5/2006 |

(Continued)

OTHER PUBLICATIONS

Search Report of European Patent Office dated Jul. 8, 2011 (8 pages) with English translation of categories of cited documents.
Search Report of German Patent Office dated Dec. 30, 2010 (4 pages) with English translation of p. 2.

*Primary Examiner* — Gary Elkins
*Assistant Examiner* — Phillip Schmidt
(74) *Attorney, Agent, or Firm* — Flynn, Thiel, Boutell & Tanis, P.C.

(57) ABSTRACT

A cup made of a paper material and having a fillable interior formed by a conical tubular wall and a bottom wall is provided. The bottom wall is joined at a bottom end of the interior to a peripheral edge frame of the tubular wall in a substantially liquid-tight manner. The tubular wall has a peripheral deforming entity around at least part of a perimeter, which peripheral deforming entity is reinforced in order to avoid deformation of the paper cup.

19 Claims, 7 Drawing Sheets

(56) References Cited

U.S. PATENT DOCUMENTS

| | | | | |
|---|---|---|---|---|
| 7,100,770 | B2 * | 9/2006 | D'Amato | 206/505 |
| 7,451,910 | B2 * | 11/2008 | Frost et al. | 229/400 |
| 7,481,356 | B2 | 1/2009 | Stahlecker | |
| 7,905,821 | B2 | 3/2011 | Stahlecker | |
| 7,984,846 | B2 | 7/2011 | Messerschmid et al. | |
| 2001/0050287 | A1 * | 12/2001 | Namba et al. | 220/592.17 |
| 2004/0094612 | A1 | 5/2004 | D'Amato | |
| 2006/0118608 | A1 | 6/2006 | Stahlecker | |
| 2006/0186012 | A1 * | 8/2006 | D'Amato | 206/505 |
| 2008/0023536 | A1 | 1/2008 | Frost et al. | |
| 2008/0023537 | A1 * | 1/2008 | Frost et al. | 229/400 |
| 2008/0029588 | A1 | 2/2008 | Messerschmid et al. | |
| 2008/0078825 | A1 * | 4/2008 | Puls et al. | 229/403 |
| 2009/0159653 | A1 | 6/2009 | Stahlecker | |

FOREIGN PATENT DOCUMENTS

| | | | | |
|---|---|---|---|---|
| DE | 10 2007 024 254 | A1 | | 1/2008 |
| EP | 0 111 356 | A1 | | 6/1984 |
| EP | 1 227 042 | A1 | | 7/2002 |
| EP | 1 227 043 | A1 | | 7/2002 |
| GB | 501225 | | | 2/1939 |
| GB | 798 908 | | | 7/1958 |
| GB | 2 420 267 | A | | 5/2006 |
| GB | 2 435 255 | A | | 8/2007 |
| GB | 2452719 | A | * | 3/2009 |
| JP | 2006-143274 | | | 6/2006 |
| WO | WO 2010/014832 | A1 | | 2/2010 |

* cited by examiner

CUP MADE OF PAPER MATERIAL AND METHOD FOR THE PRODUCTION OF A CUP MADE OF PAPER MATERIAL

CROSS REFERENCE TO RELATED APPLICATIONS

This application claims the priority of German Patent Application No. 10 2010 013 951.3, filed Mar. 30, 2010, and also claims the benefit of U.S. Provisional Application No. 61/343 880, filed May 5, 2010. The disclosures of these prior applications are hereby incorporated by reference in their entireties.

FIELD OF THE INVENTION

The invention relates to a cup made of paper material and having a fillable interior comprising a tubular wall that is at least partially conical, and a bottom wall that is joined to the tubular wall at the bottom end of its interior in a substantially liquid-tight manner, and the tubular wall delimiting the interior comprises at least one peripheral deforming entity. The invention also relates to a method for the production of a cup made of paper material.

BACKGROUND OF THE INVENTION

Cups made of paper material and comprising a peripheral deforming entity on the tubular wall are known in the prior art. Such deforming entities are provided, for example, for improving the stacking properties and the feel of such cups or also for maintaining a distance between an outer sleeve and a tubular wall so that an insulating space between the outer sleeve and the tubular wall is not compressed even when a full cup is held in the hand.

A generic cup is disclosed in European Patent EP 1 227 042. The aforementioned document describes a heat-insulating cup formed by two conical walls, the inner wall comprising an inwardly oriented groove that serves for stacking a cup of a similar type inside another cup in the stack. The inwardly oriented groove produced by a roll-in process is intended to impart effective stacking and unstacking properties to the cup without the possibility of a plurality of stacked cups becoming jammed inside each other. Experience has shown that the disclosed cup exhibits satisfactory properties that enable up to approximately 20 cups to be stacked. If substantially more cups are stacked, they become jammed inside each other. In particular, such cases of the stacked cups becoming jammed inside each other are caused by axial pressure that is directed from the open end of the cup to the bottom wall thereof as a result of the dead weight of the cups when a large number of cups are stacked together. The cups can become jammed inside each other even when a stack of 50 packed cups is put down with moderate force. Insufficient rigidity of the groove must be considered as the cause of the cups becoming jammed inside each other, but this insufficient rigidity cannot be improved on with this fabrication method, since the roll-in process to produce the groove reduces the strength of the material.

A cup having improved stacking properties over that mentioned above is described in German patent application DE 10 2004056932 A1, but this application again does not propose a satisfactory solution to the problem of the cups becoming jammed inside each other due to deformation of the tubular wall of the cup in the region of the peripheral deforming entity.

SUMMARY OF THE INVENTION

It is an object of the present invention to provide an improved cup made of paper material and an improved method for the production of a cup made of paper material.

According to the invention, a cup made of paper material is provided for this purpose, which cup has a fillable interior comprising an at least partially conical tubular wall and a bottom wall that is joined to the tubular wall at the bottom end of the interior of the cup in a substantially liquid-tight manner. The tubular wall delimiting the interior comprises at least one peripheral deforming entity, and a reinforcement for stabilizing the peripheral deforming entity is disposed in the region of the at least one peripheral deforming entity.

It has been observed, surprisingly, that a reinforcement in the region of the peripheral deforming entity can substantially improve the performance characteristics of cups made of paper material. Thus it has been established that these deforming entities that can be provided on the cup for various purposes can themselves become deformed under load to such an extent that they can no longer perform the task intended for them, namely that of enabling a plurality of cups to be stacked reliably or of maintaining a distance between the outer sleeve and the tubular wall. Surprisingly, deformation of the peripheral deforming entity occurs even though there are in fact no excessive forces actually acting on the cups made of paper materials. For example, in a stack containing a plurality of paper cups, it is only the weight of each upper cup that acts on the lower cup. By providing a reinforcement, it can be ensured that the shape of the peripheral deforming entity is not altered substantially even under load or that the shape of the peripheral deforming entity is altered only to such an extent that the peripheral deforming entity can still perform the task intended.

In a development of the invention, the reinforcement is in the form of a coating applied to the tubular wall.

For example, the reinforcement can be in the form of a coating of plastics material that is sprayed, in particular, onto the periphery of the tubular wall in the region of the peripheral deforming entity in certain parts thereof. The paper material of which paper cups are made is usually coated, for example with plastics material, on an interior surface that comes into contact with liquid. An additional coating can then be applied in the region of the peripheral deforming entity in order to stabilize the peripheral deforming entity following the production of the same.

In a development of the invention, the reinforcement is in the form of an adhesive fillet applied to the tubular wall.

It has been observed, surprisingly, that a very substantial reinforcement of the peripheral deforming entity on the tubular wall can be achieved by the simple application of an adhesive fillet. The application of an adhesive fillet is particularly simple, since the bottom wall and the tubular wall and optionally an outer sleeve of the cup are in any case joined to each other by means of adhesive. The additional application of an adhesive fillet in the region of the peripheral deforming entity thus requires no other devices than those included in conventional apparatus for the production of cups. For the purposes of the invention, the term 'adhesive' refers to glue, hot-melt adhesive, plastics adhesive, and the like.

In a development of the invention, the adhesive fillet for stabilizing the peripheral deforming entity is applied over the entire periphery of the tubular wall.

In this way, the peripheral deforming entity can be simply stabilized over the entire circumference of the tubular wall, and the adhesive fillet can also be applied without giving rise to problems, since it is in any case necessary to establish a liquid-tight connection, for example, when joining the bottom wall of the cup to the tubular wall around the entire circumference of the cup. Advantageously, the adhesive fillet is positioned at a constant level around the entire circumference of the tubular wall. Depending on the type of peripheral deforming entity and the type of adhesive used, it can be advantageous when the adhesive fillet is disposed on that side of the tubular wall that is remote from the interior of the cup. In this way, the adhesive fillet can be completely hidden from view in a double-walled insulated cup, since the adhesive fillet is located between the insulating outer sleeve and the tubular wall accommodating the liquid in the finished state of the cup.

In a development of the invention, an outer sleeve is provided that is joined to the tubular wall and/or the bottom wall by means of the adhesive fillet.

Double-walled insulated cups comprise an outer sleeve that can be slid over the actual cup or placed around the same. The adhesive fillet for stabilizing the peripheral deforming entity can at the same time be used for joining the outer sleeve, for example at the bottom end thereof, to the tubular wall or to the bottom wall of the cup. In this way, the adhesive applied can perform a double function, namely that of stabilizing the peripheral deforming entity, on the one hand, and of securely attaching the outer sleeve on the other.

In a development of the invention, the reinforcement is in the form of a separate reinforcing component, more particularly a reinforcing ring.

The peripheral deforming entity can be stabilized on the tubular wall by the provision of a separate reinforcing component. Advantageously, the reinforcing component is configured to match that region of the peripheral deforming entity that requires reinforcement. The reinforcing component can be made, for example, of plastics material and can be in the form of a ring of plastics material, for example. A ring of such type can be slid over the external surface of the tubular wall, or alternatively inserted into the interior of the cup, and secured in the region of the peripheral deforming entity. When the reinforcing component is placed in the interior of the cup, this reinforcing component can also be used for attaching additional components that do not directly form part of the cup, such as a lid or a component comprising a filling orifice, provided that the reinforcing component is disposed in the region of the open end of the cup. For example, a part of an insulating outer sleeve that is positioned to form a ring around the inner cup in the region of the peripheral deforming entity and that is additionally glued to the inner cup can also serve as a separate reinforcing component.

In a development of the invention, the peripheral deforming entity is in the form of a means for supporting a cup of a similar type in the stacked state of a plurality of cups.

For example, the peripheral deforming entity is in the form of a reentrant heel-shaped shoulder extending into the interior of the cup or a groove having an approximately semicircular cross-section.

In a development of the invention, the bottom wall and the tubular wall form a peripheral edge frame in the region of the liquid-tight joint, the peripheral deforming entity being in the form of means for supporting the peripheral edge frame of another cup of a similar type in the stacked state of a plurality of cups.

The provision of a reinforcement in the region of the peripheral deforming entity has proved to be particularly advantageous in such an embodiment of the peripheral deforming entity, that is to say, a peripheral deforming entity in the form of a support for the peripheral edge frame of another cup. The peripheral deforming entity can be reinforced very simply by the application of an adhesive fillet, and it has been found, surprisingly, that the peripheral deforming entity can withstand even very large stacking loads when provided with reinforcement. In the cup of the invention, there is no fear of a plurality of cups becoming jammed inside each other, not even in a stack containing a very large number of cups.

In a development of the invention, the cup comprises an outer sleeve that surrounds the tubular wall at least in part, the peripheral deforming entity being in the form of a means for supporting the outer sleeve of a cup of a similar type in the stacked state of a plurality of cups.

For example, the cups are stacked by means of the peripheral deforming entity disposed on the tubular wall and by means of the peripheral edge frame of the outer sleeve. In this case also, reinforcement in the region of the peripheral deforming entity can substantially improve the stacking properties of such cups.

In a development of the invention, the peripheral deforming entity represents a constriction, at least in certain regions, in the cross-section of the interior, when viewed from the open end of the cup in the direction of the bottom wall, the reinforcement being disposed directly downstream of the region of constricted cross-section.

In this way, particularly when the peripheral deforming entity is provided in the form of means for supporting cups of a similar type when stacking a plurality of cups, the reinforcement can prevent the peripheral deforming entity from losing its shape in the loaded state and thus causing the stacked cups to become jammed inside each other. As a result of the reinforcement being disposed directly downstream of the region of constricted cross-section, the peripheral deforming entity will be deformed in such a way, at most, that the stacked upper cup outwardly presses that portion of the tubular wall of the underlying cup that is located above the area of constricted cross-section, but the stacked upper cup will not slide down below that region of the underlying cup that has a constricted cross-section, which would otherwise inevitably cause the stacked cups to become jammed inside each other.

In a development of the invention, the reinforcement rests against that portion of the peripheral deforming entity that forms the reduction of cross-section on the external surface of the tubular wall that is remote from its interior.

In this way, an adhesive fillet, a separate reinforcing component, or a reinforcement applied in the form of a coating enables the tubular wall of the cup to be reinforced precisely in that region which is exposed to the largest deformation forces in the stacked state of a plurality of cups.

The object of the invention is also achieved by a method for the production of a cup made of paper material, which method includes the following steps:

- joining a conical or cylindrical tubular wall to the bottom wall of a cup in a substantially liquid-tight manner,
- incorporating at least one peripheral deforming entity in the tubular wall, and
- providing a reinforcement in the region of the at least one peripheral deforming entity for stabilizing the at least one peripheral deforming entity.

The method of the invention enables a peripheral deforming entity disposed in the tubular wall to be reinforced in a very simple manner. For the purpose of providing the reinforcement, it is merely necessary to apply additional material to the paper material of the cup. Unlike injection-molded cups of plastics materials, it is extremely problematic to provide reinforcements on paper cups, which, of course, are of a continuous, substantially constant material thickness. The invention solves this problem in that a reinforcement is provided in the region of the at least one peripheral deforming entity following the production of the peripheral deforming entity in the tubular wall.

In a development of the invention, the reinforcement is provided on that external surface of the tubular wall that is remote from the interior of the cup.

In this way, the interior of the cup that comes into contact with liquid remains unaffected by the application of the reinforcement so that, if need be, the reinforcement can be composed, for example, of material that should not come into contact with the liquid for extended periods of time.

In a development of the invention, an adhesive fillet is applied in the region of the peripheral deforming entity in order to stabilize the at least one peripheral deforming entity.

A particularly effective and particularly simple reinforcement can be achieved by the application of an adhesive fillet. As a rule, an application of adhesive is required in any case for joining the tubular wall to the bottom wall, for the production of a conical component from the paper blank to form the tubular wall and also for attaching the outer sleeve. Thus, the method of the invention makes it possible to use conventional apparatus for the production of paper cups for the application of an additional adhesive fillet in the region of the peripheral deforming entity to stabilize the peripheral deforming entity.

The stacking and unstacking properties of cups are substantially improved by the invention. In particular, it is possible to stack substantially more cups than in the prior art, and these do not become jammed inside each other, not even when a stack containing a large number of stacked cups is dropped abruptly or when a large axial thrust acts on the stacked cups in some other way, as is possible when loading a cup magazine, for example.

The cup might be deformed and lose its circular shape due to application of a peripheral deforming entity, but this is likewise prevented by the invention.

According to the invention, the peripheral deforming entity is reinforced by the purposeful application of a coating, preferably a hot-melt adhesive customarily used in this field. Furthermore, the peripheral deforming entity of the tubular wall of the cup can be reinforced by means of a component that is in the form of a ring, for example, which preferably already has the shape of the peripheral deforming entity. A component of this type is preferably made of plastics material or paper. The location at which this ring is attached to the tubular wall of the cup is not relevant in this context regarding the question as to whether or not this ring is located on the inside or outside of the tubular wall of the cup.

The disadvantage of the cup disclosed in EP 1 227 042 B1 is that the forces occurring when stacking the cups are absorbed by means of the tubular wall delimiting the interior of the cup and by means of the outer sleeve. The forces that are derived from the first supporting means and that have to be absorbed inside the cup by the second supporting means are initially absorbed by way of the tubular wall delimiting the interior by the joint between the inner tubular wall and the outer sleeve, and are then absorbed by way of this joint by the outer sleeve. In the outer sleeve, the forces are then absorbed by the second supporting means that is in the form of a roll-in entity, and are absorbed at this point by the next cup. As a result, both the tubular wall and the outer sleeve have to be configured so as to be strong enough to resist the resultant forces. Furthermore, the joint between the outer sleeve and the tubular wall must also be designed so as to withstand the maximum forces occurring.

The freedom of design of the cup disclosed in EP 1 227 042 B1 is detrimentally restricted, since the second supporting means attached to the outer sleeve must always match the dimensions of the first means for supporting another cup of a similar type and be capable of absorbing the relevant forces. It is not possible to provide the outer sleeve with an arbitrary shape or to alter its shape as desired. Furthermore, it is not possible to dispense with the outer sleeve, if need be, without losing the effective stacking properties of the cup.

The stackable cup is preferably produced by means of a method including the following steps:

- shaping at least a first means for supporting another cup of a similar type on the tubular wall delimiting the interior;
- shaping a second supporting means on the peripheral edge frame, which second supporting means can cooperate, when the cups are stacked, with a first supporting means attached to another cup of similar type.

The second supporting means is disposed on the tubular wall delimiting the interior or on the bottom wall or on a joint that joins the tubular wall delimiting the interior to the bottom wall. In any case, the second supporting means is attached to a component of the cup that is in contact with the fillable interior.

The advantage of the cup of the invention is that it can be stacked in a secure and stable manner with or without an outer sleeve and also unstacked without the cups becoming jammed inside each other, and it is possible to provide the cup with a heat-insulating outer sleeve.

The tubular wall delimiting the interior and the bottom wall are in any case strong enough to resist the forces occurring when stacking the cups, since they are also required to resist the forces occurring when filling the cups.

In order to prevent a plurality of cups from becoming jammed inside each other when stacking the same, it is advantageous when the dimensions of the second supporting means match those of the first means for supporting another cup of a similar type. The first means for supporting another cup of a similar type can in fact be arbitrarily shaped. The important factor is that the first means should have a contour that can resist the forces acting in the axial direction of the cup, that is to say, forces acting between two cups during the stacking process. The first supporting means is preferably in the form of a bead or a groove that is produced at least in a region around the circumference of the cup in the tubular wall delimiting its interior. The bead or groove can be shaped so as to extend continuously or discontinuously around the circumference of the cup.

In one embodiment of the invention, a heat-insulating outer sleeve is provided for the cup, the design of the heat-insulating outer sleeve being arbitrary as such. For example, the outer sleeve can be made of a plastics material, of paper, or of composite material. For improving the insulating properties, the outer sleeve may be corrugated, ribbed, or embossed, or it can be provided with a foam layer. The outer sleeve can alternatively be in the form of a multilayered component. For example, it can comprise a corrugated intermediate layer that is covered by an outer layer in flat contact therewith. By virtue of the fact that the cup of the invention can be stacked irrespective of the outer sleeve, it is possible to combine one and the same inner cup in a simple and almost arbitrary manner with a wide variety of outer sleeves. Without altering the shape and dimensions of the inner cup and the components forming the fillable interior, it is possible to produce different cups having variable optical and haptical properties, since the appearance of the cup as registered by the user is mainly determined by the design of the outer sleeve.

Furthermore, the bottom roll-in end of the outer sleeve shown in FIGS. 3*a*, 3*b*, and 3*d* can also be used as an additional reinforcing element for the peripheral deforming entity.

Furthermore, a ring that is preferably made of plastics material is provided according to the invention for reinforcing the peripheral deforming entity.

This ring can have the shape of the region of the peripheral deforming entity that requires support. Furthermore, the peripheral deforming entity itself can be produced, according to the invention, with the aid of the ring, this ring being pressed into the tubular wall of the cup.

The ring should preferably be glued to the tubular wall of the cup in cases where the forces occurring when the ring is pressed into the tubular wall of the cup are not sufficient to fix the ring permanently.

Additional features and advantages of the invention are revealed in the claims and in the following description of preferred embodiments of the invention, with reference to the drawings. Individual features of the various embodiments shown can be combined as required without going beyond the scope of the present invention.

DETAILED DESCRIPTION

Figure 1:
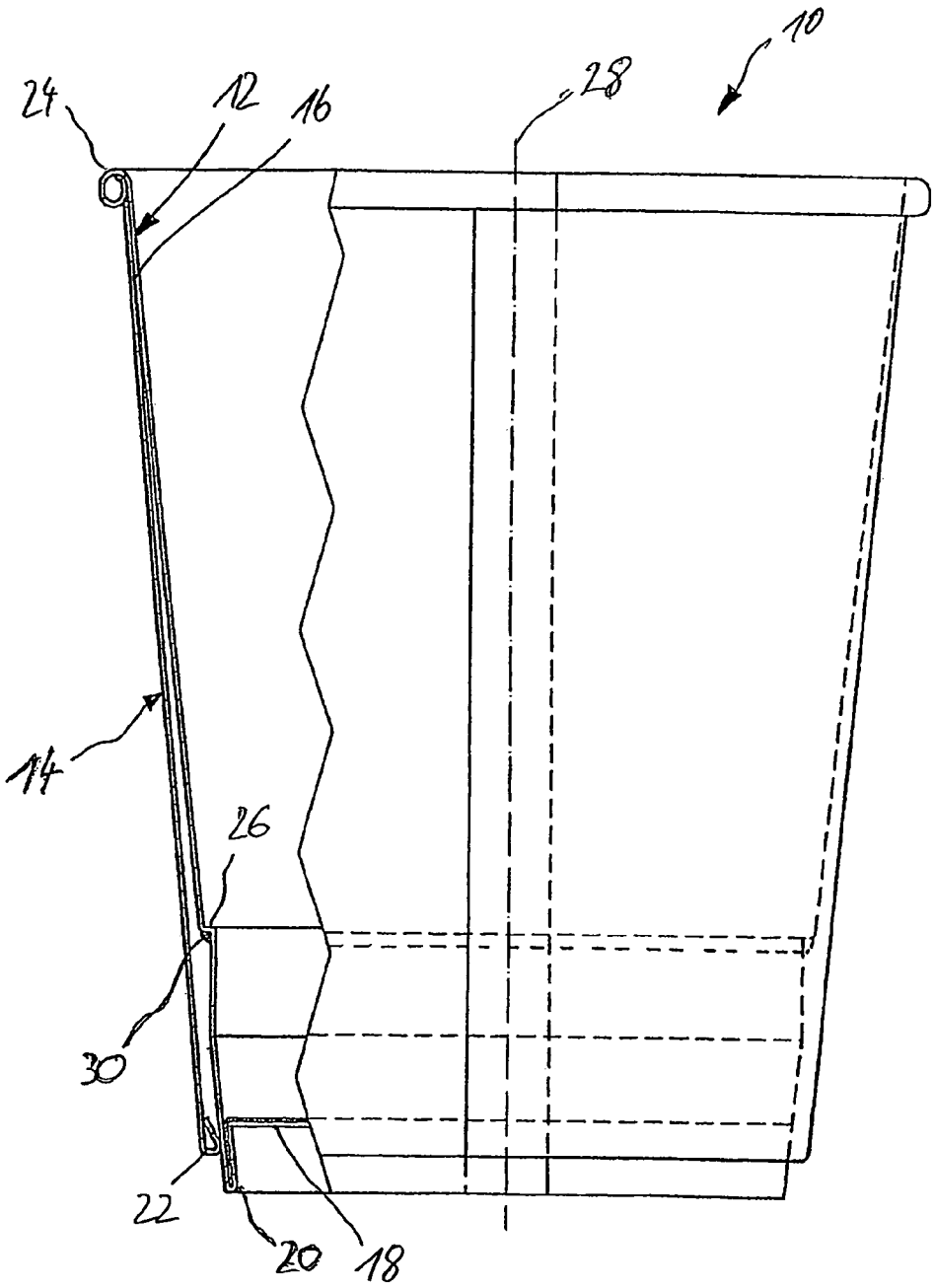
FIG. 1 is a view of a longitudinal cross-section of a cup of the invention according to a first embodiment.

FIG. 1 illustrates a double-walled heat-insulating cup 10 comprising an inner cup 12 and an outer. sleeve 14. The inner cup 12 consists of a substantially conical tubular wall 16 and a bottom wall 18, the tubular wall 16 and the bottom wall 18 being joined to each other in a liquid-tight manner to form a peripheral edge frame 20. The peripheral edge frame 20 is formed by a U-shaped fold of the tubular wall 16, into which an approximately right-angled edge of the pot-shaped bottom wall 18 has been inserted. Following the insertion of the edge, the peripheral edge frame 20 is completed by gluing, pressing, and/or sealing the tubular wall 16 to the bottom wall 18.

The outer sleeve 14 is slid on like a casing and it likewise has a conical shape. The bottom end of the outer sleeve 14 is in the form of a lower bead 22. The lower bead 22 of the outer sleeve 14 rests against the inner cup 12 below the horizontal portion of the bottom wall 18. The top end of the outer sleeve 14 rests against the inner cup 12 so as to adjoin a mouth bead 24 that forms the top end of the cup 10.

A peripheral deforming or deformed entity in the form of a heel-shaped shoulder 26 extending into the interior of the inner cup 12 is provided on the tubular wall 16 of the inner cup 12 approximately at the level of a quarter of the vertical dimension of the interior of the inner cup 12. The shoulder 26 is formed by an abrupt reduction in the diameter of the interior as viewed from the open end of the cup 10 defined by the mouth bead 24 toward the bottom wall 18, in that the tubular wall 16 is bent approximately horizontally toward a longitudinal center axis 28 of the cup. The tubular wall 16 then extends parallel to the longitudinal center axis 28 over a portion thereof to again assume a conical shape over a final portion reaching down to the bottom end of the cup 10. The shoulder 26 thus protrudes into the interior of the cup 10. For stabilizing the peripheral deforming entity in the form of the shoulder 26, an adhesive bead or an adhesive fillet 30 is provided that is disposed below the approximately horizontal portion of the shoulder 26 on the external surface of the tubular wall 16. The adhesive fillet 30 thus does not come into contact with a liquid filling the interior of the cup 10. As can be seen in FIG. 1, the adhesive fillet 30 is introduced into the approximately right-angled cavity formed by the heel-shaped shoulder 26 on the external surface of the tubular wall 16 remote from its interior.

The shoulder 26 is provided as a means for supporting a cup of a similar type when a number of cups are stacked together. More specifically, the lower bead 22 of another cup of a similar type is supported on the shoulder 26 when two cups are stacked. The adhesive fillet 30 reinforces the peripheral deforming entity in the form of the shoulder 26 even in the case of heavy loads. The adhesive fillet also prevents the cups from becoming jammed inside each other when numerous cups are stacked together or when a stack of cups is dropped down abruptly.

Figure 2:
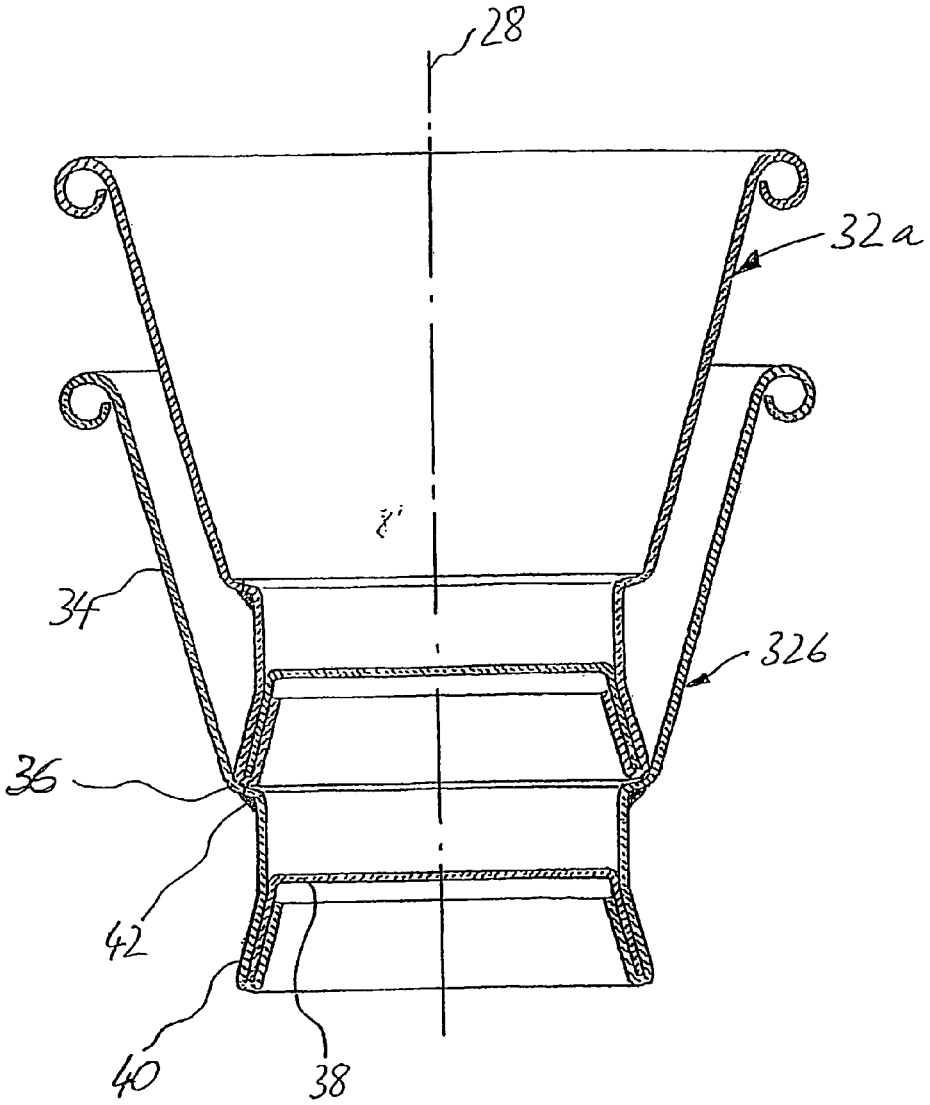
FIG. 2 is a view of a longitudinal cross-section of two stacked cups of the invention according to a second embodiment.

FIG. 2 illustrates a longitudinal cross-section of two stacked cups 32*a*, 32*b* according to a second preferred embodiment of the invention. The cups 32*a*, 32*b* are stacked into each other and are each in the form of a single-walled cup. However, it is readily possible to provide both cups 32*a*, 32*b* with an insulating outer sleeve in the manner of the outer sleeve shown in FIG. 1, since there is again sufficient space between the two cups 32*a*, 32*b* in the stacked state.

As can be seen FIG. 2, a tubular wall 34 of the cups 32*a*, 32*b* is provided in the region of its lower half with a peripheral deforming entity 36 in the form of a heel-shaped shoulder protruding into the interior. The tubular wall 34 and a bottom wall 38 of each cup 32*a*, 32*b* are joined to each other in a liquid-tight manner to form a peripheral edge frame 40. The peripheral edge frame 40 is flared outwardly so as to form a truncated cone. In the stacked state of the two cups 32*a*, 32*b*, the bottom edge of the cup and thus the lower, free end of the peripheral edge frame 40 rests on the peripheral deforming entity 36. In order to reinforce this peripheral deforming entity 36, an adhesive fillet 42 is applied to an external surface of the tubular wall 34 in the region of the cavity formed by the peripheral deforming entity 36. The adhesive fillet 42 is applied around the entire circumference of the tubular wall 34. The adhesive fillet 42 reinforces the peripheral deforming entity 36 to the effect that the heel-shaped peripheral deforming entity 36 of the lower cup may possibly be deformed when strong pressure is applied to the upper cup 32*a*, but the lower cup 32*b* will at all events be prevented from expanding in the region of the peripheral deforming entity 36 and from allowing the upper cup 32*a* to then slide further down into the lower cup 32*b*. Rather, the shoulder-shaped peripheral deforming entity 36 will at most be deformed in such a way that the portion on which the peripheral edge frame 40 of the upper cup 32*a* rests will bend into the horizontal. There is no fear of the two cups 32*a*, 32*b* becoming jammed inside each other.

The peripheral deforming entity 36 is in the form of a shoulder and it thus represents a reduction in the cross-section of the tubular wall 34. The constriction 36 can thus absorb forces that act toward the center axis 28 of the cup; that is, forces acting when the cups 32*a*, 32*b* are stacked. The constriction 36 is in the form of a shoulder and it extends into the interior of the cup. The peripheral edge frame 40, at which the tubular wall 34 delimiting the interior of the cup is folded around the pot-shaped, deep-drawn bottom wall 38 and to which the tubular wall 34 is sealed in a liquid-tight manner, is outwardly expanded and thus represents means for supporting a cup of a similar type, which cooperates with the shoulder-shaped constriction 36 when two cups 32*a*, 32*b* are stacked.

Figure 3A:
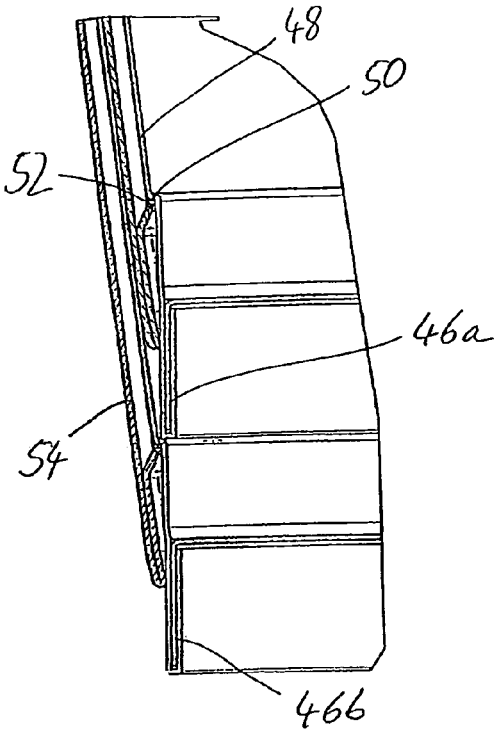
FIGS. 3*a* to 3*d* are partial views of longitudinal cross-sections of any two cups of the invention according to a third, fourth, fifth, and sixth embodiment.

FIG. 3*a* illustrates a partial view of a longitudinal cross-section of two stacked cups 46*a*, 46*b* according to a further embodiment of the invention. The cups 46*a*, 46*b* are each provided with a peripheral deforming entity in the form of a shoulder 50 protruding into the interior. An adhesive fillet 52 for stabilizing the shoulder 50 is provided on an external surface of the tubular wall 48 in the cavity formed by the shoulder 50. An outer sleeve 54 of the cups 46*a*, 46*b* is folded in its lower region through 180°, and the folded free end is then in turn bent toward the inner cup 46*a* to rest against the adhesive fillet 52. In this way, the adhesive fillet 52 can perform a double function in that it not only stabilizes the shoulder 50 but also ensures that the outer sleeve 54 is securely joined to the tubular wall 48 of the inner cup 46*a* since the free end of the outer sleeve 54 is adhesively joined to the tubular wall 48 by the adhesive fillet 52. Alternatively, there is no adhesive joint and the free end of the outer sleeve 54 only rests against the adhesive fillet. In the embodiment shown, the outer sleeve 54 rests against the tubular wall 48 below the bottom wall and, via its folded end, against the adhesive fillet 52.

Figure 3B:
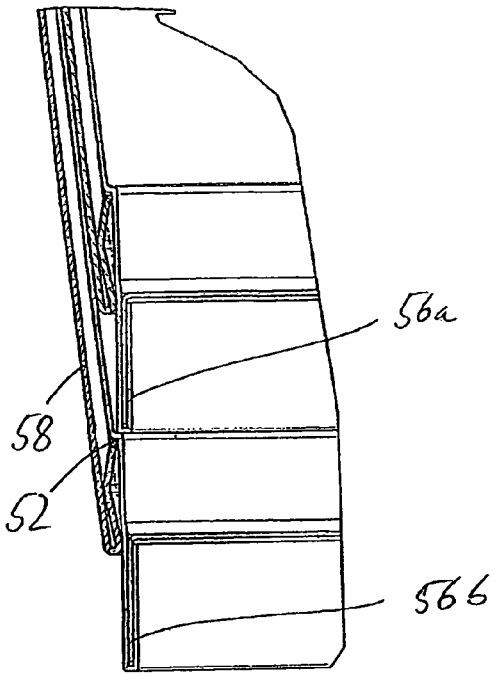

FIG. 3*b* illustrates a partial view of a longitudinal cross-section of two stacked cups 56*a*, 56*b* of the invention according to a further embodiment of the invention. This differs from the cups 46*a*, 46*b* shown in FIG. 3*a* only in that the fold of the outer sleeve 58 of each cup is shaped differently. The bottom end of the outer sleeve 58 is folded through 180°, and this fold is not flattened, but is instead bulged around a small diameter. The folded free end is then again bent toward the inner cup 56*a* to rest against the adhesive fillet 52.

Figure 3C:
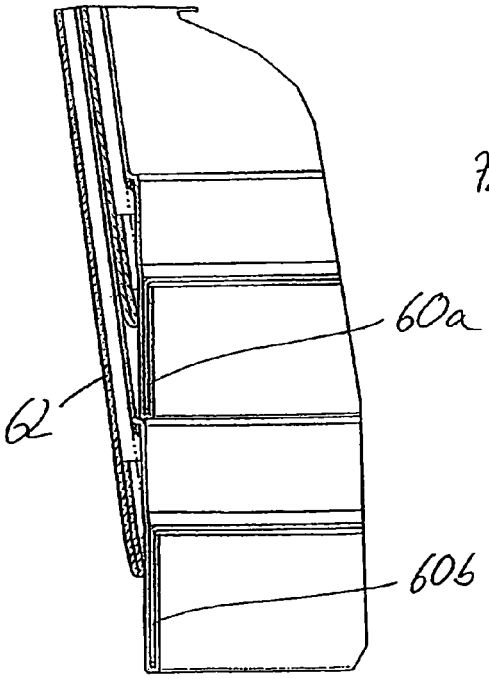

FIG. 3*c* shows a partial view of a longitudinal cross-section of two stacked cups 60*a*, 60*b* of the invention. The cups 60*a*, 60*b* differ from those shown in FIGS. 3*a* and 3*b* merely in terms of the shape of the bottom end of the respective outer sleeve 62. The outer sleeve 62 is folded at its bottom end and bent slightly in toward the inside so that the bottom end of the outer sleeve 62 rests, below the bottom wall of the cups 60*a*, 60*b*, against the peripheral edge frame by means of which the tubular wall and the bottom wall are joined to each other in a liquid-tight manner. The folded portion of the bottom end of the outer sleeve 62 is flattened so that the folded portion also rests with its entire surface against the internal surface of the outer sleeve 62.

Figure 3D:
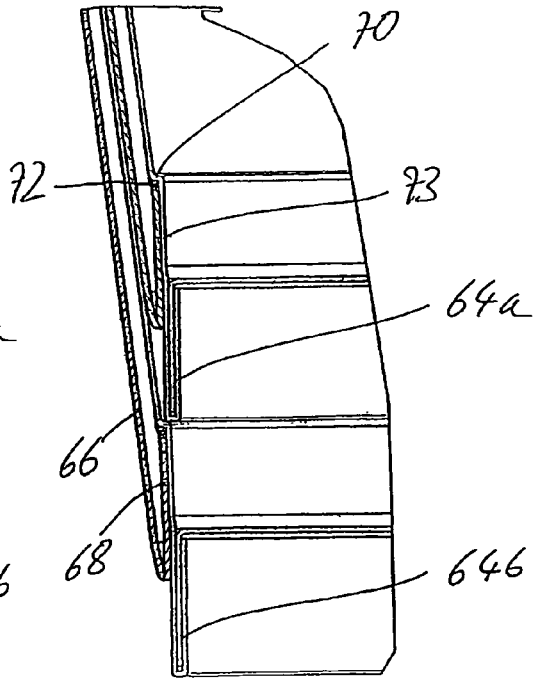

FIG. 3*d* shows a longitudinal cross-section of two further cups 64*a*, 64*b* of the invention. The cups 64*a*, 64*b* differ from those shown in FIGS. 3*a* to 3*c* merely in terms of the shape of the lower end of the outer sleeve 66. The outer sleeve 66 is folded at its bottom end by slightly less than 180° such that the folded portion of the outer sleeve 66 rests flat against the external surface of the tubular wall of the cups 64*a*, 64*b*. The folded portion 68 of the outer sleeve 66 thus forms a ring that rests, below the peripheral deforming entity 70, on the external surface of the tubular wall. The end of the folded portion 68 extends up to the peripheral deforming entity 70, and the top edge of the folded portion 68 rests against the adhesive fillet 72. By folding the outer sleeve 66, an additional separate reinforcement is thus achieved, by means of which the constriction 70 and that section 73 of the cup that is located between the constriction 70 and the bottom wall can be reinforced.

Figure 4:
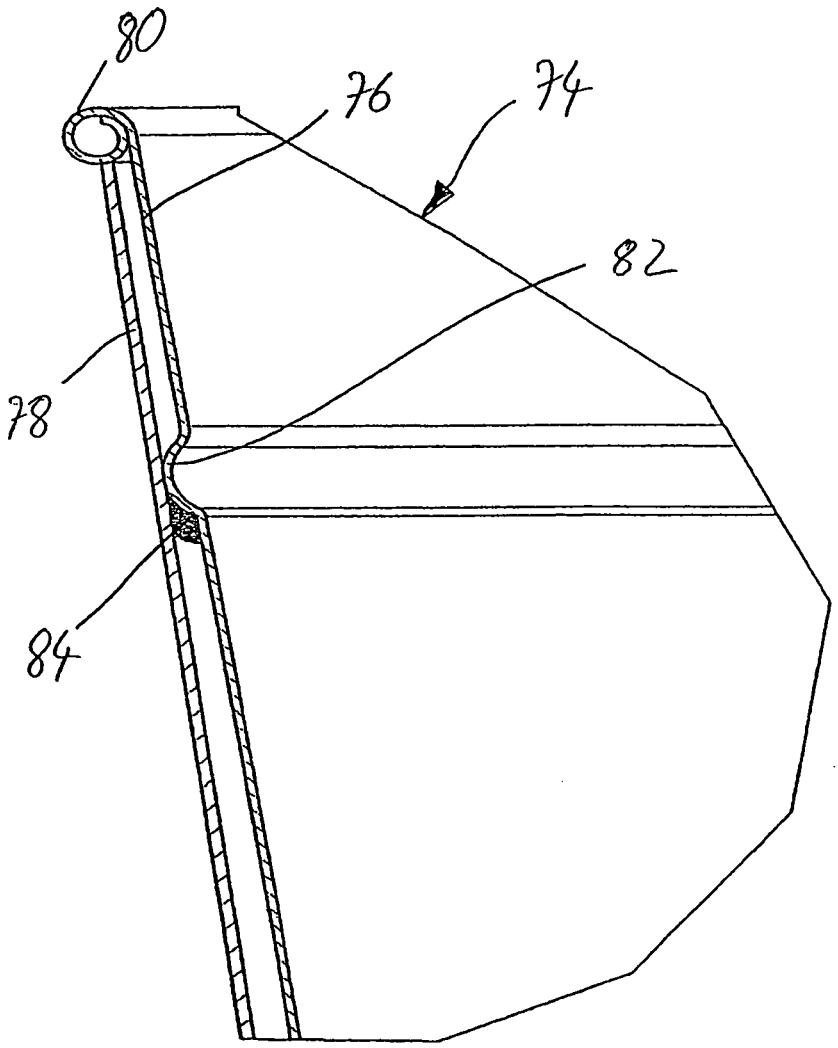
FIG. 4 is a partial view of a longitudinal cross-section of a cup of the invention according to a seventh embodiment.

FIG. 4 shows a partial view of a longitudinal cross-section of a further cup 74 of the invention. The cup 74 comprises an inner cup comprising a tubular wall 76 and an insulating outer sleeve 78. The tubular wall 76 is provided with a peripheral deforming entity 82 below a mouth bead 80, the peripheral deforming entity 82 being in the form of a bead or a groove extending outwardly away from the interior of the cup 74. The peripheral deforming entity 82 serves to ensure a precisely defined distance between the outer sleeve 78 and the tubular wall 76 and thus provides satisfactory insulating properties. The peripheral deforming entity 82 is reinforced by means of an adhesive fillet 84 disposed below the peripheral deforming entity 82 as illustrated in FIG. 4, and the adhesive fillet 84 adjoins the bottom portion of the peripheral deforming entity 82. As can be seen from the figure, the adhesive fillet 84 stabilizes the peripheral deforming entity 82, on the one hand, and at the same time adhesively joins the outer sleeve 78 to the tubular wall 76, on the other.

Figure 5:
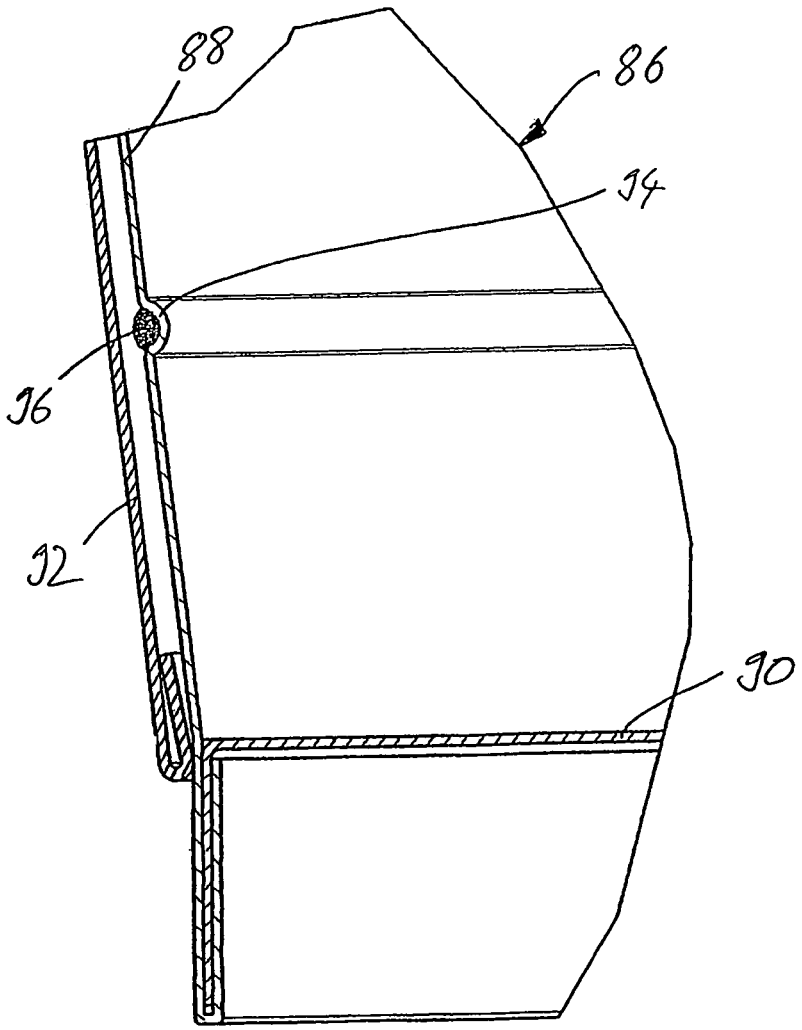
FIG. 5 is a partial view of a longitudinal section of a cup of the invention according to an eighth embodiment.

FIG. 5 shows another cup 86 of the invention according to a further embodiment of the invention. The cup 86 comprises an inner cup comprising a tubular wall 88 and a bottom wall 90 that are joined to each other in a liquid-tight manner in the region of a downwardly flared peripheral edge frame. Furthermore, the cup 86 comprises an insulating outer sleeve 92 that rests against the tubular wall 88 below the horizontally extending portion of the bottom wall 90. The bottom end of the outer sleeve 92 is used for stacking the cup 86 in that the bottom end of the outer sleeve 92 rests against a bead-shaped or groove-shaped peripheral deforming entity 94 in the tubular wall 88 in the stacked state of two cups. The peripheral deforming entity 94 is approximately in the form of a semicircle or an arc of a circle and it extends into the interior of the cup 86. The peripheral deforming entity 94 is formed, for example, by means of a roller moving around a periphery of the tubular wall. In order to stabilize the peripheral deforming entity 94, the indentation formed by the peripheral deforming entity 94 on the external surface of the tubular wall 88 is filled out by an adhesive fillet 96. The adhesive fillet 96 thus stabilizes the peripheral deforming entity 94 so that the outer sleeve 92 cannot slide beyond the peripheral deforming entity 94 when the cups are stacked. In this way, several cups can be stacked without any fear of them becoming jammed inside each other.

Figure 6:
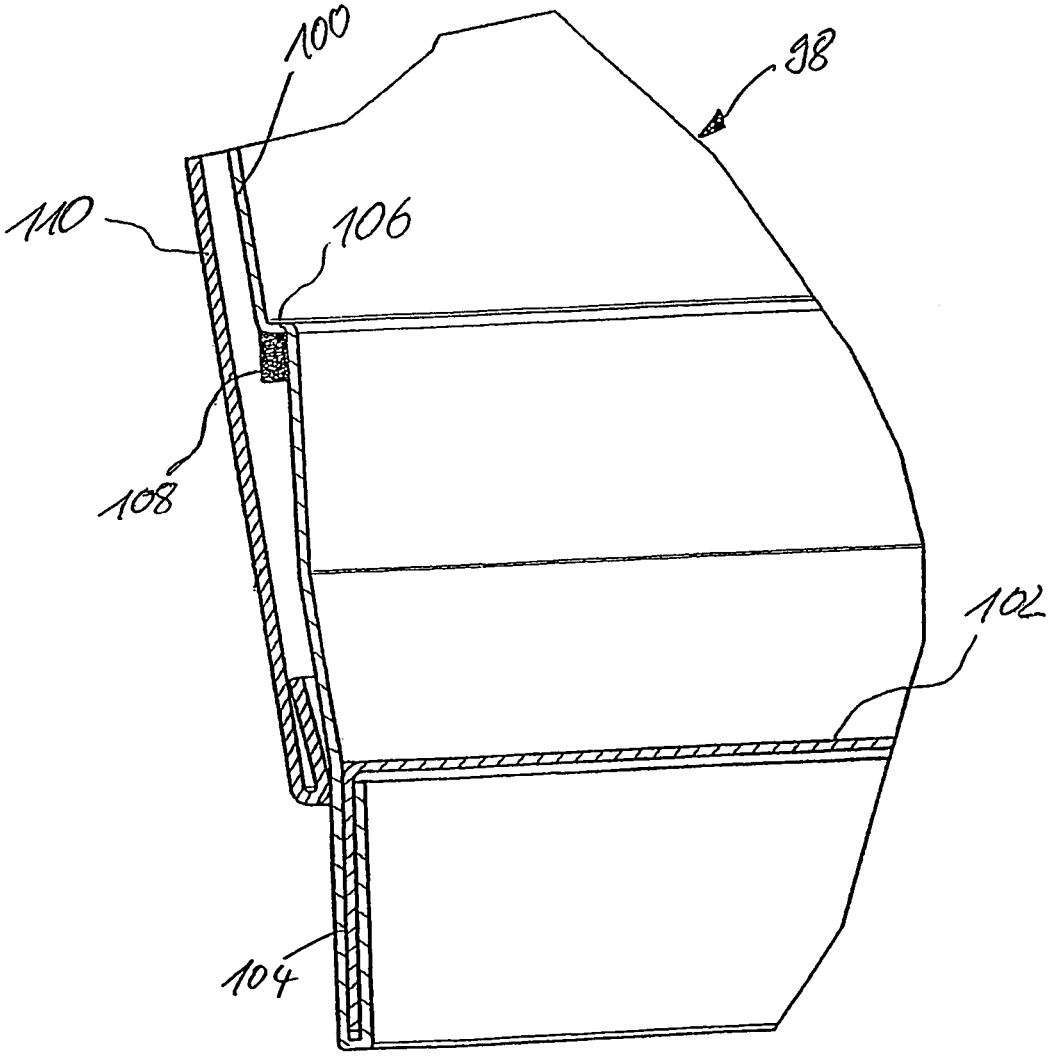
FIG. 6 is a partial view of a longitudinal cross-section of a cup of the invention according to a ninth embodiment, in which a device shown here in the form of a ring is fitted from outside to the tubular wall of the cup for reinforcing the peripheral deforming entity.

FIG. 6 shows a further cup 98 of the invention in a partial longitudinal cross-section. The cup 98 comprises an inner cup comprising a tubular wall 100 and a bottom wall 102 that are joined to each other in a liquid-tight manner to form a flared peripheral edge frame 104. The bottom wall 102 is as a whole in the form of an inverted pot, and a folded edge thereof is inserted into a U-shaped fold of the tubular wall 100 such that the circumferential peripheral edge frame 104 is formed. The frame 104 is conical and it flares out toward the bottom end of the cup 98. The tubular wall 100 is provided with a peripheral deforming entity in the form of a reentrant shoulder 106, which abruptly reduces the inside diameter of the cup 98. In the stacked state of a plurality of cups, the lower end of the peripheral edge frame 104 bears on the shoulder 106.

In order to stabilize the shoulder 106, a reinforcing ring 108 made of plastics material is provided below the shoulder 106, which reinforcing ring 108 is slid over an external surface of the tubular wall 100 to rest against the underside of the shoulder 106. The reinforcing ring 108 remains on the tubular wall 100 in the finished state of the cup 98. After the reinforcing ring 108 has been slid into position, an insulating outer sleeve 110 can be slid onto the inner cup and attached to the same.

Figure 7A:
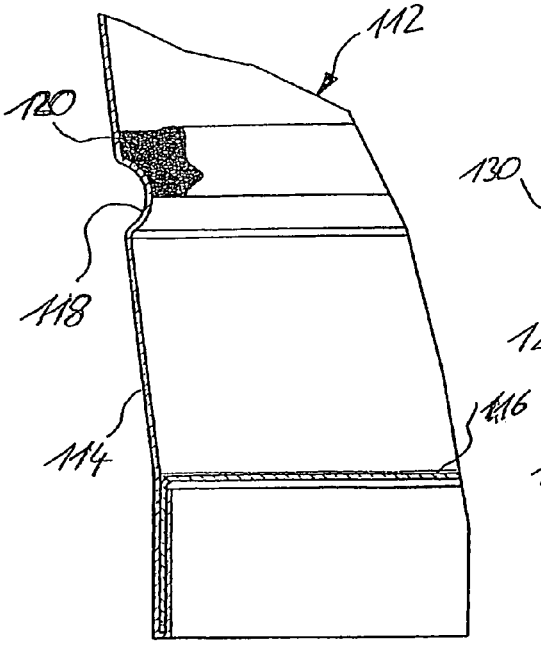
FIGS. 7*a* and 7*b* are partial views of longitudinal cross-sections of the cup of the invention according to tenth and eleventh embodiment respectively, in which a device shown here in the form of a ring is fitted from inside to the tubular wall of the cup for reinforcing the peripheral deforming entity.

FIG. 7*a* shows a further cup 112 of the invention that is provided with a tubular wall 114 and a bottom wall 116. The tubular wall 114 is provided with a groove-shaped peripheral deforming entity 118 that protrudes into the interior of the cup 112. For stabilizing the peripheral deforming entity 118, a plastic ring 120 is provided that is inserted from the top into the interior of the cup 112 to rest against the upper portion of the peripheral deforming entity 118. The plastic ring 120 can be used, for example, to make it possible to stack a plurality of cups. The plastic ring 120 can also be used, for example, to accommodate additional components that are not directly part of the cup 112, such as a clip-on lid, a glued-on membrane, or a disk comprising a filling orifice.

Figure 7B:
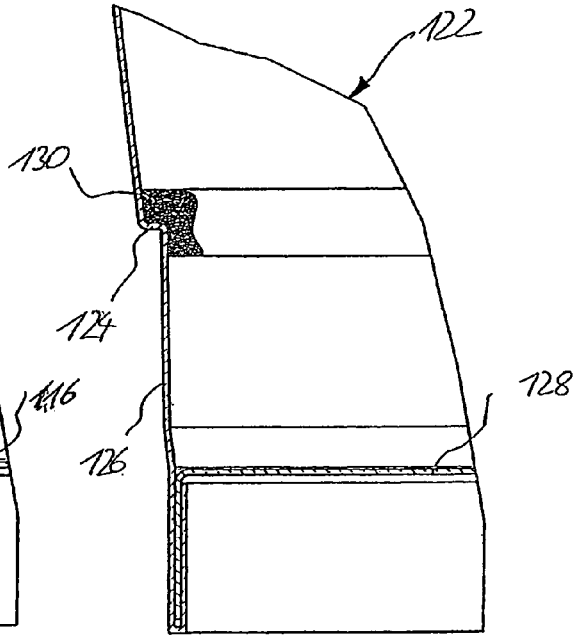

FIG. 7*b* shows a further cup 122 of the invention. Unlike the cup 112 shown in FIG. 7*a*, the cup 122 is provided with a peripheral deforming entity in the form of a reentrant shoulder 124. A tubular wall 126 of the cup 122 extends below the shoulder 124 substantially parallel to the center axis of the cup 122 in order to re-assume a conical shape just above the bottom wall 128. A plastic ring 130 is inserted into the interior of the cup 122, which plastic ring 130 is provided with a circumferential reentrant heel that rests against the shoulder 124 and thus reinforces the same. The reinforcing ring 130 may, but not necessarily, be glued to the tubular wall 126. As a result of the conical shape of the tubular wall 126 above the shoulder 124, the reinforcing ring 130 can also be held securely on the cup 122 without the use of adhesive. The reinforcing ring 130 can be used for securely stacking a plurality of cups, but can also be used, for example, for accommodating membranes, lids, or the like.

It is expressly stated that the various designs of the outer sleeve and other shaping means of the cup such as the peripheral deforming entity can be arbitrarily combined with each other as required and are not restricted to the variants shown. Furthermore, it should be noted that the illustrations are not drawn to scale.

The invention claimed is:

1. A cup of a paper material comprising a fillable interior formed by an at least partially conical and interior delimiting tubular wall and a bottom wall, the bottom wall being joined to the tubular wall in a region of a bottom end of the interior in a substantially liquid-tight manner, wherein the tubular wall comprises at least one peripheral deforming entity disposed adjacent the bottom wall, the peripheral deforming entity including a groove formed in the tubular wall and a rib which projects inwardly into the interior, a top of the rib having a cup-supporting surface disposed to support a cup of the same type in a vertical stack of a plurality of the cups, the groove opening outwardly immediately adjacent and opposite the rib, and a reinforcement attached to the cup and disposed in the groove for stabilizing the rib.

2. The cup according to claim 1, wherein the reinforcement is in the form of a coating applied to the tubular wall.

3. The cup according to claim 1, wherein the reinforcement is in the form of an adhesive fillet applied to the tubular wall.

4. The cup according to claim 3, wherein the adhesive fillet is applied over an entire periphery of the tubular wall within the groove for stabilizing the rib.

5. The cup according to claim 1, wherein the cup has an outer sleeve at least partially surrounding the tubular wall, and the cup-supporting surface is disposed to support the outer sleeve of a cup of the same type in a vertical stack of a plurality of the cups.

6. The cup according to claim 1, wherein the rib forms an at least partial cross-sectional constriction of the interior of the cup, as viewed from an open end of the cup toward the bottom wall, the reinforcement being disposed directly downstream of the cross-sectional constriction.

7. The cup according to claim 6, wherein the reinforcement is disposed against and in contact with the tubular wall on an external surface thereof and in the groove remote from the interior of the cup in that region thereof in which the rib forms the cross-sectional constriction.

8. The cup according to claim 1, wherein the reinforcement is fixed to the tubular wall within the groove of the peripheral deforming entity.

9. The cup according to claim 1, wherein the cup-supporting surface is disposed closer to the bottom end of the interior than to a top end of the interior of the cup.

10. A method for producing a cup of paper material, the method comprising the steps of: joining a conical tubular wall to a bottom wall of the cup in a substantially liquid-tight manner, incorporating at least one peripheral deforming entity in the tubular wall adjacent the bottom wall such that the peripheral deforming entity includes a groove formed in the tubular wall and a rib projecting inwardly into an interior of the cup, a top of the rib having a cup-supporting surface disposed to support a cup of the same type in a vertical stack of a plurality of the cups, and such that the groove of the peripheral deforming entity opens outwardly immediately adjacent and opposite the rib, and providing a reinforcement attached to the cup and disposed in the groove of the peripheral deforming entity for stabilizing the rib.

11. The method according to claim 10, including providing the reinforcement on an exterior surface of the tubular wall remote from the interior of the cup.

12. A method according to claim 10, wherein the step of providing the reinforcement includes providing an adhesive fillet in the groove of the peripheral deforming entity for stabilizing the rib.

13. The method according to claim 10, wherein the step of providing the reinforcement includes fixing the reinforcement to the tubular wall within the groove.

14. The method according to claim 10, wherein the step of incorporating the peripheral deforming entity includes providing the peripheral deforming entity closer to the bottom wall than to a top end of the cup.

15. A cup of a paper material comprising:

a fillable interior formed by an at least partially conical and interior delimiting tubular wall and a bottom wall, the bottom wall and the tubular wall being joined to one another in a region of a bottom end of the interior in a substantially liquid-tight manner in the form of a liquid-tight joint, the bottom wall and the tubular wall forming a peripheral edge frame in a region of the liquid-tight joint, the tubular wall comprising at least one peripheral deforming entity, the peripheral deforming entity being disposed to support a peripheral edge frame of a cup of the same type in a stack comprising a plurality of the cups; and a reinforcement for stabilizing the peripheral deforming entity, the reinforcement being in a region of the peripheral deforming entity and being in the form of an adhesive fillet applied to the tubular wall for stabilizing the peripheral deforming entity over the entire periphery of the tubular wall, wherein the peripheral deforming entity forms an at least partial cross-sectional constriction of the interior of the cup, as viewed from an open end of the cup toward the bottom wall, and defines a recess in the tubular wall which opens outwardly, the adhesive-fillet being disposed directly downstream of the cross-sectional constriction, and the adhesive fillet is disposed against the tubular wall and within the recess thereof on an external surface of the tubular wall remote from the interior of the cup in a region thereof in which the peripheral deforming entity forms the cross-sectional constriction.

16. A cup of paper material having a central longitudinal axis, said cup comprising:

a tubular wall having oppositely facing interior and exterior surfaces and having a conical configuration along a portion of said tubular wall, said tubular wall being deformed inwardly towards the cup axis so as to define a shoulder having a cup-supporting surface located interiorly of said cup along said interior surface of said tubular wall, said shoulder defining an inwardly-projecting cavity at said exterior surface of said tubular wall opposite and immediately adjacent said cup-supporting surface;

a bottom wall joined to said tubular wall adjacent a bottom region thereof in a substantially liquid-tight manner, said cup-supporting surface of said shoulder being disposed closer to said bottom wall than to a top region of said tubular wall, being oriented substantially parallel to said bottom wall, and facing away from said bottom wall for supporting a cup in a vertical stack of a plurality of said cups; and a reinforcement attached to and in contact with said exterior surface of said tubular wall within said cavity for stabilizing said shoulder.

17. The cup according to claim 16, wherein said reinforcement is fixed to said exterior surface of said tubular wall within said cavity.

18. The cup according to claim 16, wherein said cup-supporting surface projects towards the cup axis inwardly beyond a portion of said interior surface of said tubular wall disposed between said cup-supporting surface and said top region of said tubular wall.

19. The cup according to claim 16, wherein said reinforcement has a shape which conforms to a shape of said cavity and is in direct contact with said exterior surface of said tubular wall.

* * * * *